US010691157B2

(12) United States Patent
Saito

(10) Patent No.: US 10,691,157 B2
(45) Date of Patent: Jun. 23, 2020

(54) OPERATION LEVER AND WORK VEHICLE

(71) Applicant: Komatsu Ltd., Tokyo (JP)

(72) Inventor: Shun Saito, Tokyo (JP)

(73) Assignee: KOMATSU LTD., Tokyo (JP)

( * ) Notice: Subject to any disclaimer, the term of this patent is extended or adjusted under 35 U.S.C. 154(b) by 124 days.

(21) Appl. No.: 15/754,301

(22) PCT Filed: Nov. 24, 2017

(86) PCT No.: PCT/JP2017/042231

§ 371 (c)(1),
(2) Date: Feb. 22, 2018

(87) PCT Pub. No.: WO2019/102588

PCT Pub. Date: May 31, 2019

(65) Prior Publication Data

US 2019/0163225 A1 May 30, 2019

(51) Int. Cl.

| | |
|---|---|
| ***G05G 1/00*** | (2006.01) |
| ***H01H 23/02*** | (2006.01) |
| ***G05G 1/06*** | (2006.01) |
| ***G05G 9/047*** | (2006.01) |
| ***H01H 23/14*** | (2006.01) |

(Continued)

(52) U.S. Cl.
CPC ..... *G05G 1/06* (2013.01); *G05G 1/01* (2013.01); *G05G 1/02* (2013.01); *G05G 9/04788* (2013.01);

(Continued)

(58) Field of Classification Search
CPC .. G05G 1/01; G05G 1/02; G05G 1/06; G05G 9/047; G05G 9/04788; G05G 2009/04774;

(Continued)

(56) References Cited

U.S. PATENT DOCUMENTS 6,307,537 B1 10/2001 Oowada
6,892,481 B2 * 5/2005 Yamamoto ..... E02F 9/2004 324/207.2

(Continued)

FOREIGN PATENT DOCUMENTS

CN 1903150 A1 3/2008
CN 101233278 A 7/2008

(Continued)

*Primary Examiner* — Adam D Rogers

(74) *Attorney, Agent, or Firm* — Locke Lord LLP

(57) ABSTRACT

An operation lever of a work vehicle has the operation surface including: a connection portion; a front operation surface extending obliquely so that a height from a reference plane increases from the connection portion toward the forward side of the connection portion in a cross-sectional view including a front-rear directions and a front-side edge of the operation surface being defined as a front-side top portion; and a rear operation surface connected to the front operation surface, extending obliquely so that a height from the reference plane increases from the connection portion toward the backward side of the connection portion and a rear-side edge of the operation surface being defined as a rear-side top portion. A length in front-rear directions along the reference plane in the front operation surface is larger than a length in the front-rear directions along the reference plane in the rear operation surface.

18 Claims, 7 Drawing Sheets

(51) Int. Cl.
*G05G 1/01* (2008.04)
*G05G 1/02* (2006.01)
*H01H 23/30* (2006.01)

(52) U.S. Cl.
CPC ..... *H01H 23/02* (2013.01); *H01H 23/145* (2013.01); *G05G 9/047* (2013.01); *G05G 2009/04774* (2013.01); *H01H 23/30* (2013.01)

(58) Field of Classification Search
CPC .. H01H 3/02; H01H 2003/0293; H01H 21/02; H01H 23/00; H01H 23/02; H01H 23/145; H01H 23/30
See application file for complete search history.

(56) References Cited

U.S. PATENT DOCUMENTS 7,497,298 B2 * 3/2009 Shearer ..... E02F 3/7663 180/333
10,049,832 B2 * 8/2018 Nakagawa ..... H01H 13/14
2002/0169023 A1 11/2002 Tanaka
2012/0118717 A1 * 5/2012 Hanson ..... H01H 23/143 200/5 A
2013/0133469 A1 * 5/2013 Rey ..... G05G 1/06 74/558.5
2013/0233684 A1 9/2013 Kato et al.
2016/0009174 A1 1/2016 Yamauchi et al.

FOREIGN PATENT DOCUMENTS

DE 102009052241 A1 5/2011
JE 2002-318659 A 10/2002
JP 3060240 U 8/1999
JP 2000-071801 A 3/2000
JP 2002-157035 A 5/2002
JP 2011-222305 A 11/2011
JP 5140023 B2 2/2013
JP 2013-187151 A 9/2013
JP 2016-016739 A 2/2016

* cited by examiner

OPERATION LEVER AND WORK VEHICLE

TECHNICAL FIELD OF THE INVENTION

The present invention relates to an operation lever and a work vehicle.

DESCRIPTION OF THE RELATED ART

Patent document 1 discloses an operation lever of a work vehicle. The operation lever has a seesaw switch for switching forward and backward movements. A top surface of a switch knob in the seesaw switch is designated as an operation surface. When a front portion of the operation surface is pushed, the switch knob tilts forward from a neutral position and the work vehicle becomes in a state in which a forward movement is possible. On the other hand, when a rear portion of the operation surface is pushed, the switch knob tilts backward from the neutral position, and the work vehicle becomes in a state in which a backward movement is possible. An operator of the work vehicle operates the switch knob by a thumb while gripping a grip portion of the operation lever.

PRIOR ART DOCUMENT

[Patent Document]

[Patent document 1] Japanese unexamined patent application, first publication No. 2000-71801

BRIEF SUMMARY OF THE INVENTION

Problems to be Solved by the Invention

When the operator switches the forward movement and the backward movement of the work vehicle by operating the switch knob, depending on the size of the thumb of the operator, there are cases where it is necessary to greatly bend the thumb.

Depending on sites where the work vehicle is operated, there are cases where a plurality of operators operate the work vehicle alternately for a predetermined work vehicle, and it is required to operate the operation lever and the switch knob without each operator feeling discomfort and fatigue.

The present invention was made in view of such problems, and an object thereof is to provide an operation lever and a work vehicle capable of switching easily the forward movement and the backward movement of the work vehicle without the operator feeling discomfort and fatigue.

Means for Solving the Problem

An aspect of the present invention provides an operation lever, including: a lever body including a grip portion extending vertically and a head portion provided on an upper end of the grip portion; and a switch knob having an operation surface exposed on a front surface of the head portion, and provided so as to be rotatable around a rotation axis extending in a width direction between a forward position and a backward position, the forward position being a position tilted forward from a neutral position, the backward position being a position tilted backward from the neutral position. The operation surface includes: a connection portion extending in the width direction; a front operation surface extending obliquely so that a height from a reference plane perpendicular to a straight line passing through a rotation axis and the connection portion increases from the connection portion toward the forward side of the connection portion in a cross-sectional view perpendicular to the rotation axis, and a front-side edge of the operation surface being defined as a front-side top portion; and a rear operation surface connected to the front operation surface via the connection portion, extending obliquely so that a height from the reference plane increases from the connection portion toward the backward side of the connection portion, and a rear-side edge of the operation surface being defined as a rear-side top portion, wherein a length in front-rear directions along the reference plane in the front operation surface is larger than a length in the front-rear directions along the reference plane in the rear operation surface, and wherein a height of the front-side top portion from the reference plane is higher than a height of the rear-side top portion from the reference plane.

Another aspect of the present invention provides a work vehicle, including: a driver's seat; and the above-described operation lever provided so as to be capable to turn right and left directions to turn either one side in a right or left direction of the driver's seat which is one direction in the width direction.

Effects of the Invention

According to the operation lever and the work vehicle of the above aspects, it is possible to easily switch the forward movement and the backward movement of the work vehicle without the operator feeling discomfort and fatigue.

DETAILED DESCRIPTION OF THE INVENTION

Hereinafter, embodiments of a wheel loader as an example of a work vehicle according to the present invention will be described in detail with reference to the drawings.

<Work Vehicle>

Figure 1:
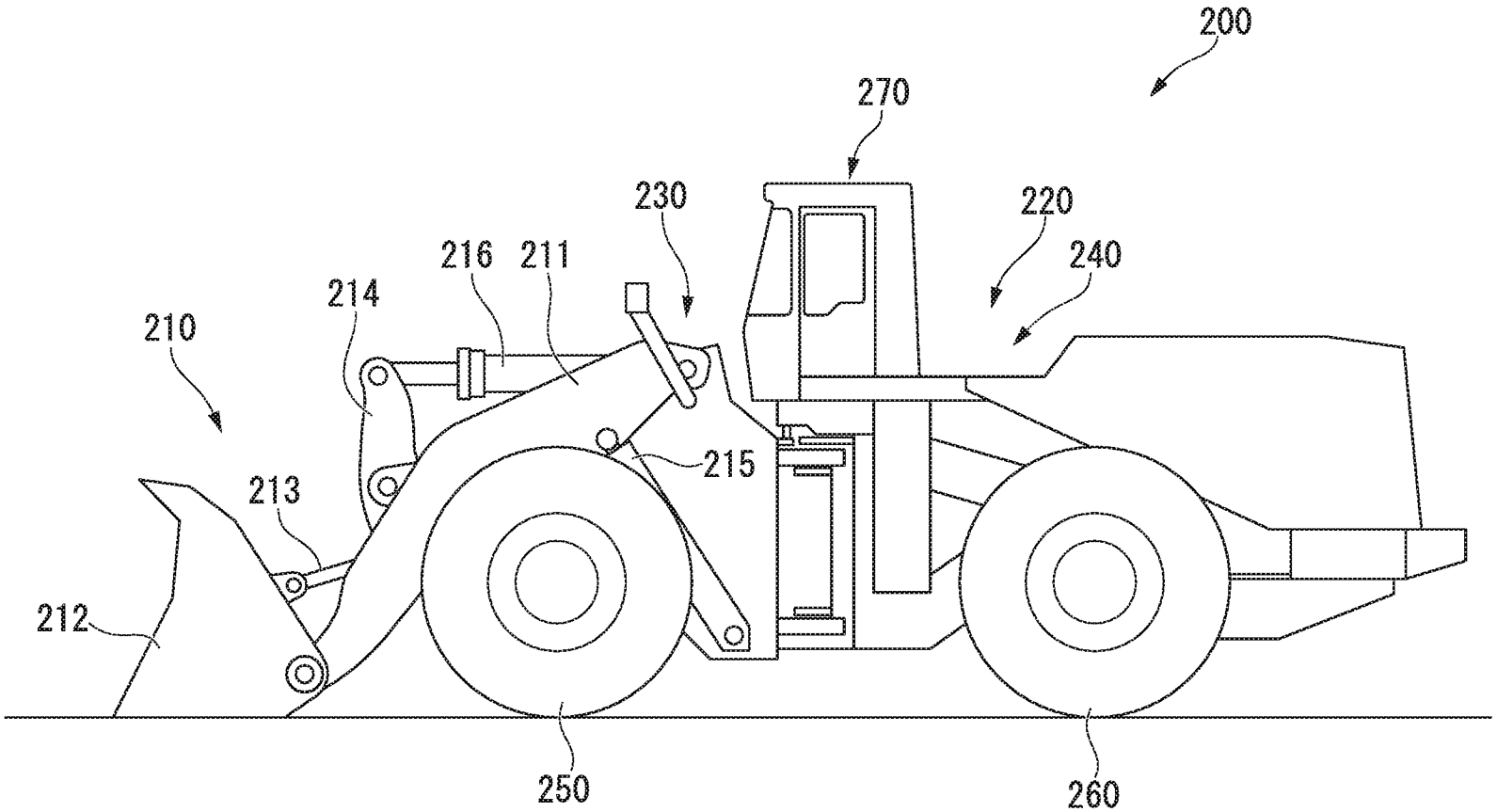
FIG. 1 is a side view of a wheel loader as a work vehicle according to an embodiment of the present invention.

As shown in FIG. 1, a wheel loader 200 as the work vehicle has working equipment 210 and a vehicle body 220. In the following, the forward movement direction of the vehicle body 220, the backward movement direction of the vehicle body 220, and a width direction of the vehicle body 220 are respectively referred as "vehicle forward direction", "vehicle backward direction" and "vehicle width direction". The vehicle width direction may also be referred to as "left side (first side in the vehicle width direction)" or "right side (second side in the vehicle width direction)". A vertical direction, an upward direction, and a downward direction in a state where the vehicle body 220 is arranged on the horizontal plane are respectively simply referred to as "vertical direction", "upward" and "downward".

<Working Equipment>

The working equipment 210 is provided at a front of the vehicle body 220. The working equipment 210 has a boom 211 and a bucket 212. The boom 211 is rotatably linked to the vehicle body 220. The bucket 212 is connected to one end of a bell crank 214 via a link 213. A bucket-driving cylinder 216 is connected to the other end of the bell crank 214. The bucket 212 is rotatably connected to a tip of the boom 211. The boom 211 is driven by a boom-driving cylinder 215, and the bucket 212 is driven by the bucket-driving cylinder 216. The boom-driving cylinder 215 and the bucket-driving cylinder 216 are driven by a hydraulic pressure supplied via the hydraulic circuit.

<Vehicle Body>

A vehicle body 220 includes a vehicle front portion 230, a vehicle rear portion 240, front wheels 250, rear wheels 260, and a cab 250.

The vehicle front portion 230 constitutes a front portion of the vehicle body 220. The working equipment 210 is provided on the vehicle front portion 230 of the vehicle body 220. The vehicle rear portion 240 constitutes a rear portion of the vehicle body 220, and is connected on a side in the vehicle backward direction of the vehicle front portion 230. Since the vehicle front portion 230 and the vehicle rear portion 240 are connected around an axis extending in the vertical direction, it is possible to rotate in the horizontal direction with each other. By moving forward or backward in a state in which the vehicle front portion 230 and the vehicle rear portion 240 are rotated relatively to each other, the vehicle body 220 of the wheel loader 200 turns toward a right or left side (a right turn or a left turn). A pair of front wheels 250 is provided in the vehicle front portion 230 with a distance in the vehicle width direction. A pair of rear wheels 260 is provided in the vehicle rear portion 240 with a distance in the vehicle width direction. The vehicle body 220 moves forward or backward by the front wheels 250 and the rear wheels 260 being driven.

<Cab>

Figure 2:
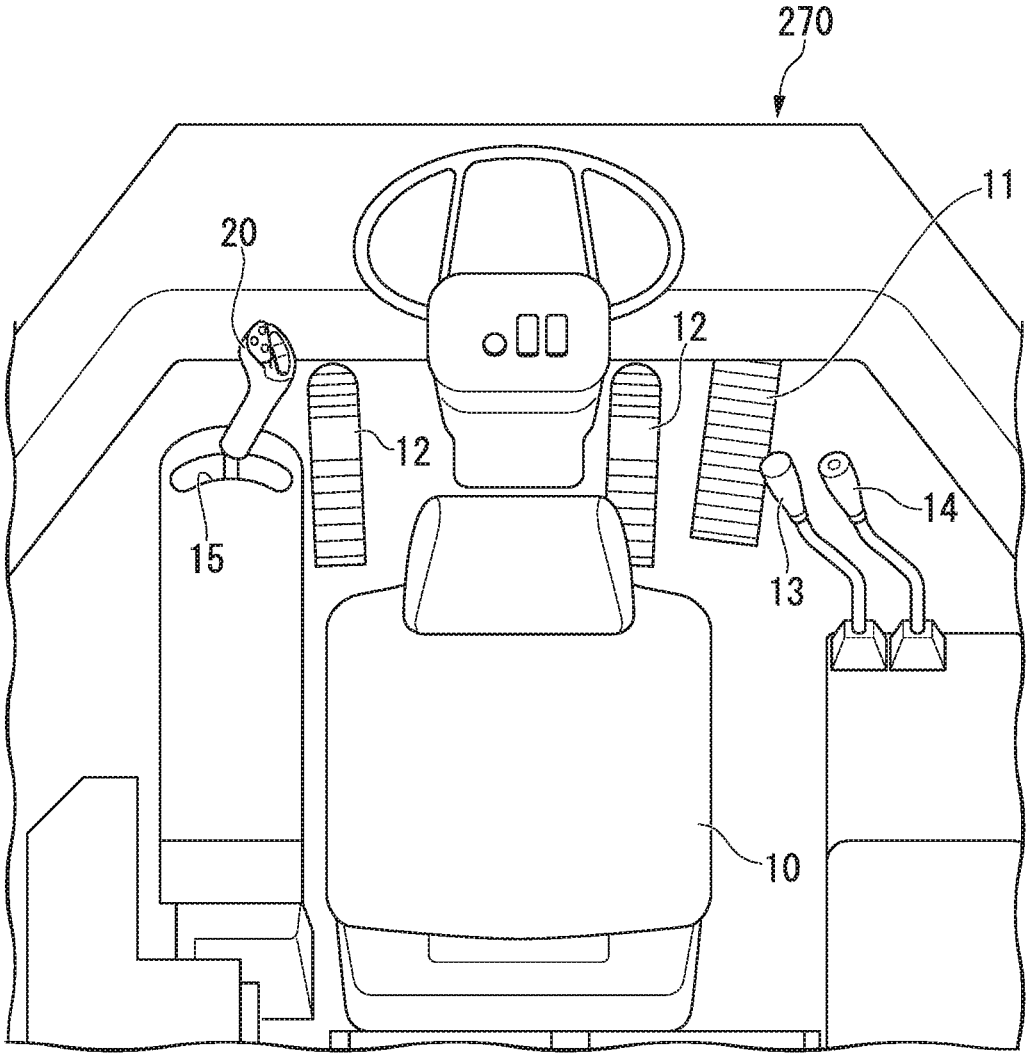
FIG. 2 is a view of an inside of a cockpit of the work vehicle according to the embodiment of the present invention as viewed from back and top of the vehicle.

A cab 250 is provided at a front portion and a top portion of the vehicle rear portion 240. Inside of the cab 250 is a cockpit for an operator. As shown in FIG. 2, the cockpit includes a driver's seat 10, an accelerator pedal 11, a brake pedal 12, a bucket operation lever 13, a lift arm operation lever 14, and a direction-switching operation lever 20 (an operation lever).

The driver's seat 10 is provided at a center in the vehicle width direction of the cockpit in the cab 270. The driver's seat 10 is disposed so that the operator seated in the driver's seat 10 can look over the vehicle forward side of the wheel loader 200.

The accelerator pedal 11 is disposed at the vehicle forward side of the driver's seat 10 and on a right side of a lower part of the driver's seat 10. A pair of brake pedals 12 is disposed at the vehicle forward side of the driver's seat 10 and in the lower part of the driver's seat 10 so as to be separated in left and right.

The bucket operation lever 13 is a lever for a tilting or dumping operation of the bucket 216 of the working equipment 210, and is disposed on the right side of the driver's seat 10. The lift arm operation lever 14 is the lever for operating vertically the boom 211 of the working equipment 210, and is disposed on a right side of the driver's seat 10 and on a further right side of the bucket operation lever 13. The bucket operation lever 13 and the lift arm operation lever 14 are operated by a right hand of the operator.

<Direction-Switching Operation Lever>

Next, the direction-switching operation lever 20 will be described. The direction-switching operation lever 20 is operated to switch the forward movement, the backward movement, the right turn, and the left turn of the vehicle body 220. The direction-switching operation lever 20 is operated by a left hand of the operator seated on the driver's seat 10.

The direction-switching operation lever 20 is provided so as to extend upwardly through a turning groove portion 15 formed on the left side of the driver's seat 10. The direction-switching operation lever 20 is capable of turning to a right and left direction by defining a formation range of the turning groove portion 15 as a turning range. When the direction-switching operation lever 20 is positioned at a center position of the right and left direction of the turning groove portion 15, it makes the wheel loader 200 in a state of being capable to go straight. That is, when the direction-switching operation lever 20 is in the center position of the right and left direction of the turning groove portion 15, the vehicle front portion 230 and the vehicle rear portion 240 are in a state of being not relatively rotated. On the other hand, in the state in which the direction-switching operation lever 20 is operated to turn to the left or right along the turning groove portion 15 in the vehicle width direction, it makes the wheel loader 200 in a state of being capable of turning left or right. That is, when the direction-switching operation lever 20 is operated to turn left or right along the turning groove portion 15 in the vehicle width direction, the vehicle front portion 230 and the vehicle rear portion 240 are in a state of being relatively rotated to each other.

Specifically as shown in FIGS. 3 to 6, the direction-switching operation lever 20 has a lever body 30, a horn switch 45, a downshift switch 46, an upshift switch 47, and a forward-reverse changeover switch 50.

<Lever Body>

Figure 4:
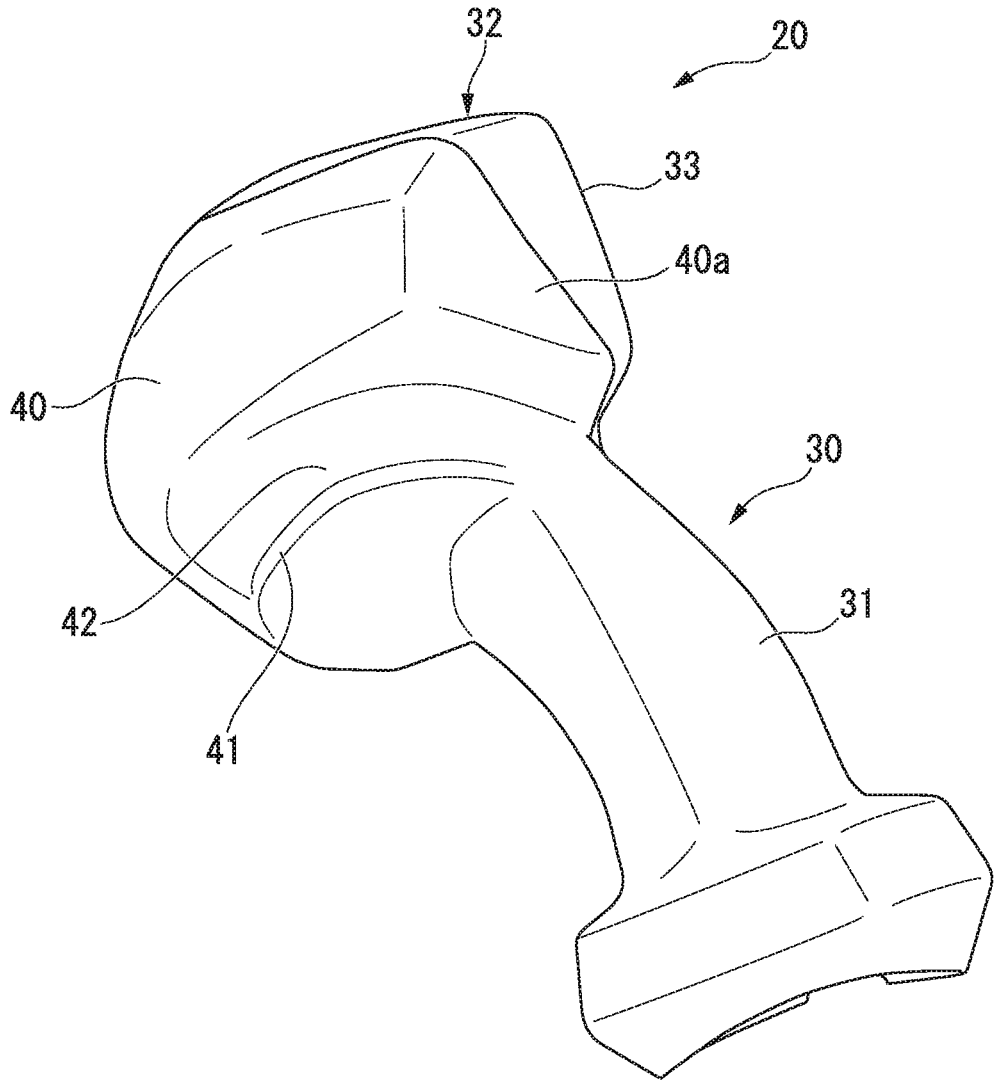
FIG. 4 is a perspective view of the operation lever of the work vehicle according to the embodiment of the present invention as viewed from a back surface side thereof.

The lever body 30 is a member that forms the outer shape of the direction-switching operation lever 20, and has a grip portion 31, a head portion 32, and a flange 41 (see FIG. 4). Each of the above-mentioned switches (the horn switch 45, the downshift switch 46, the upshift switch 47, and the forward-reverse changeover switch 50) is disposed in a head portion 32.

<Grip Portion>

The grip portion 31 has a shaft shape extending in the vertical direction. The grip portion 31 may be bent to the right side which is the driver's seat 10 side while extending from the lower side to the upper side. A posture of the grip portion 31 may be arbitrarily adjustable. An outer peripheral surface of the grip portion 31 is regarded as a grip surface grasped by the left hand of the operator seated on the driver's seat 10.

<Head Portion>

The head portion 32 is provided at an upper end of the grip portion 31. The head portion 32 has a shape that protrudes slightly larger than the grip portion 31. The head portion 32 has a front surface 33 and a back surface 40. The front surface 33 is a surface arranged in a posture such that it is oriented obliquely upward so that the operator seated on the driver's seat 10 is capable of being visually recognized. Hereinafter, in facing directions of the front surface 33 and the back surface 40, a direction on the operator side will be referred to as a front surface side and the opposite side thereof will be referred to as a back surface side. The front surface 33 of the head portion 32 may be arranged in a posture so as to be inclined toward the driver's seat 10 side, i.e., toward the right side. The back surface 40 is a surface arranged on the opposite side of the front surface 33 of the head portion 32. The back surface 40 of the head portion 32 is formed so as to protrude further toward the back surface side than the grip portion 31.

<Flange>

Figure 5:
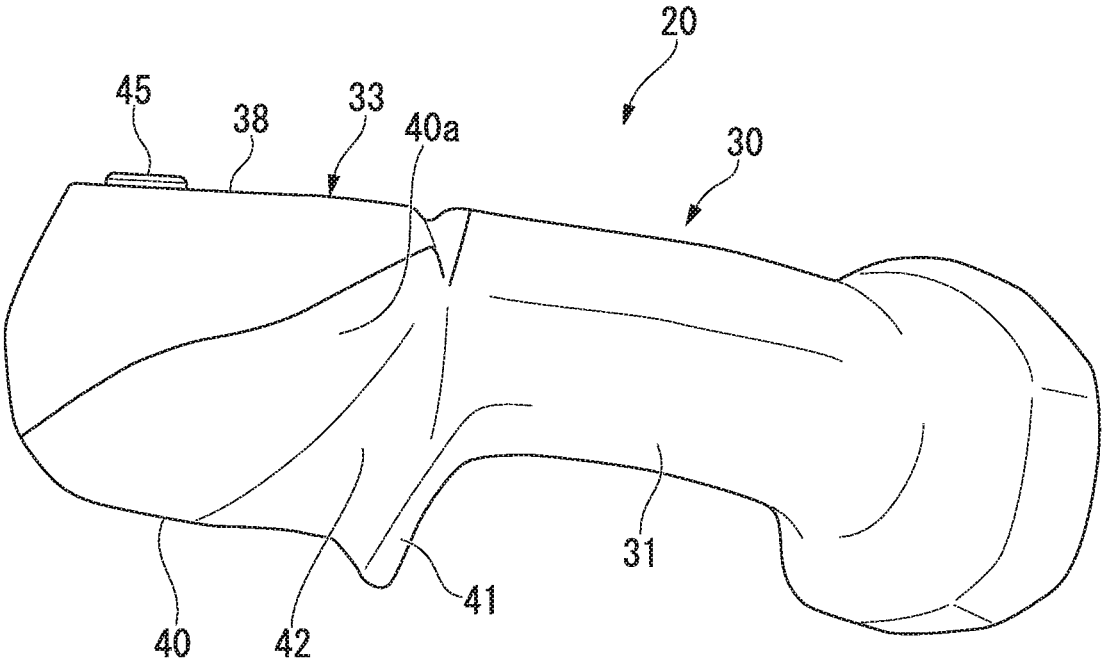
FIG. 5 is the side view of the operation lever of the work vehicle according to an embodiment of the present invention as viewed from one side in a width direction.

On the outer peripheral surface of the grip portion 31 having a rod shape, as shown in FIGS. 4 and 5, the flange 41 is provided in a partial region in a circumferential direction of the grip portion 31. The flange 41 protrudes from the outer peripheral surface of the grip portion 31 and is provided so as to extend in the circumferential direction of the grip portion 31. The flange 41 is formed at a position spaced downwardly from the head portion 32 in the outer peripheral surface of the grip portion 31. The flange 41 forms an index finger-housing space 42 that is a space having a groove shape extending in the circumferential direction, between the back surface 40 of the head portion 32 and the flange 41. In the circumferential direction of the grip portion 31, the flange 41 is formed only in a range from a position corresponding to a lateral surface 40*a* of the left side of the direction-switching operation lever 20 in the head portion 32 across a position corresponding to the back surface 40 of the head portion 32. In addition, the flange 41 may be formed only in a range corresponding to the back surface 40 of the head portion 32 in the circumferential direction of the grip portion 31.

When the operator operates the direction-switching operation lever 20, the operator places the palm of the left hand on a region lower than the flange 41 in the grip portion 31 of the direction-switching operation lever 20 and grasps this region with the middle finger, the ring finger, and the little finger of the left hand. At this time, the index finger of the left hand is housed in the index finger-housing space 42 between the flange 41 and the back surface 40 of the head portion 32.

<Front Surface of Head Portion>

Figure 3:
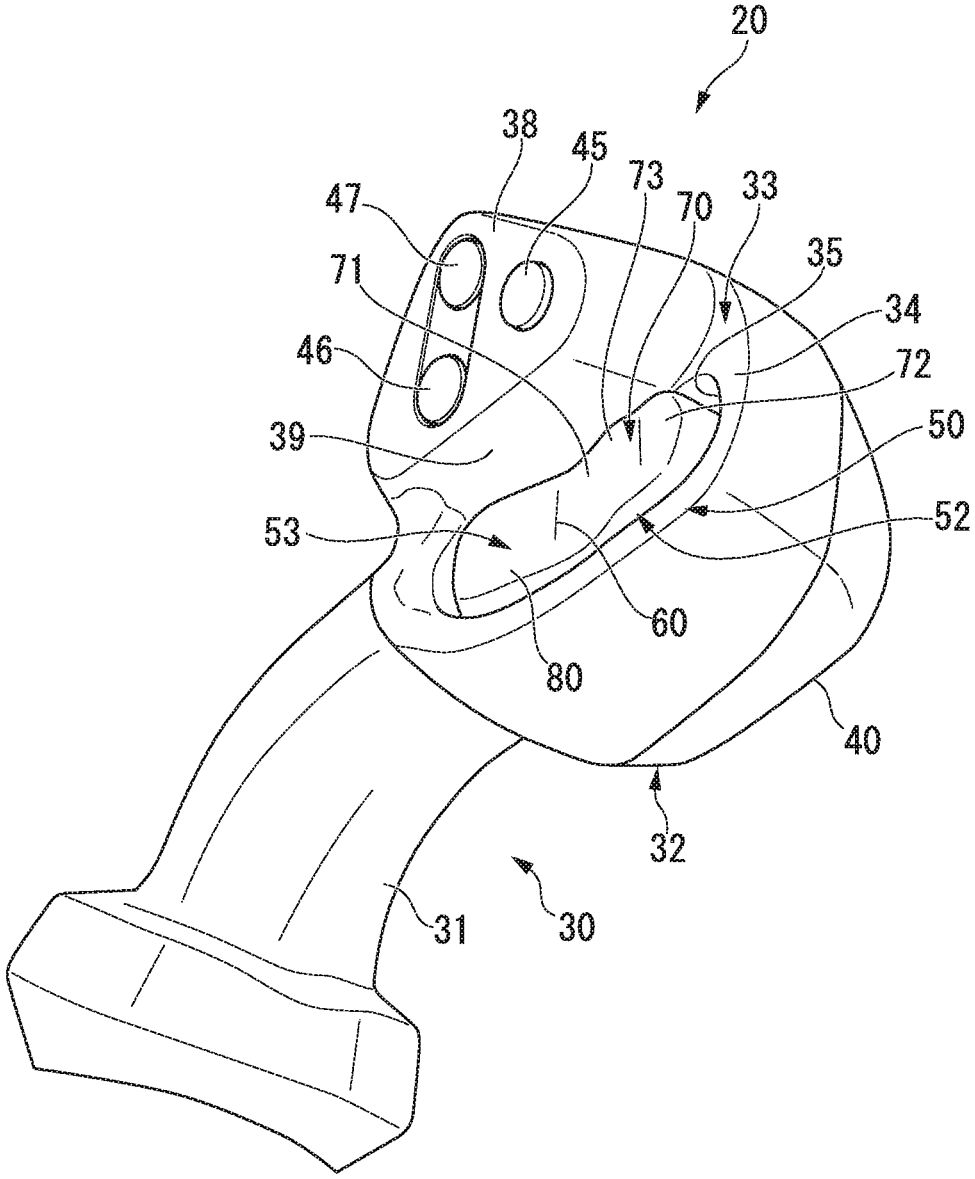
FIG. 3 is a perspective view of an operation lever of the work vehicle according to the embodiment of the present invention as viewed from a front surface side thereof.
Figure 6:
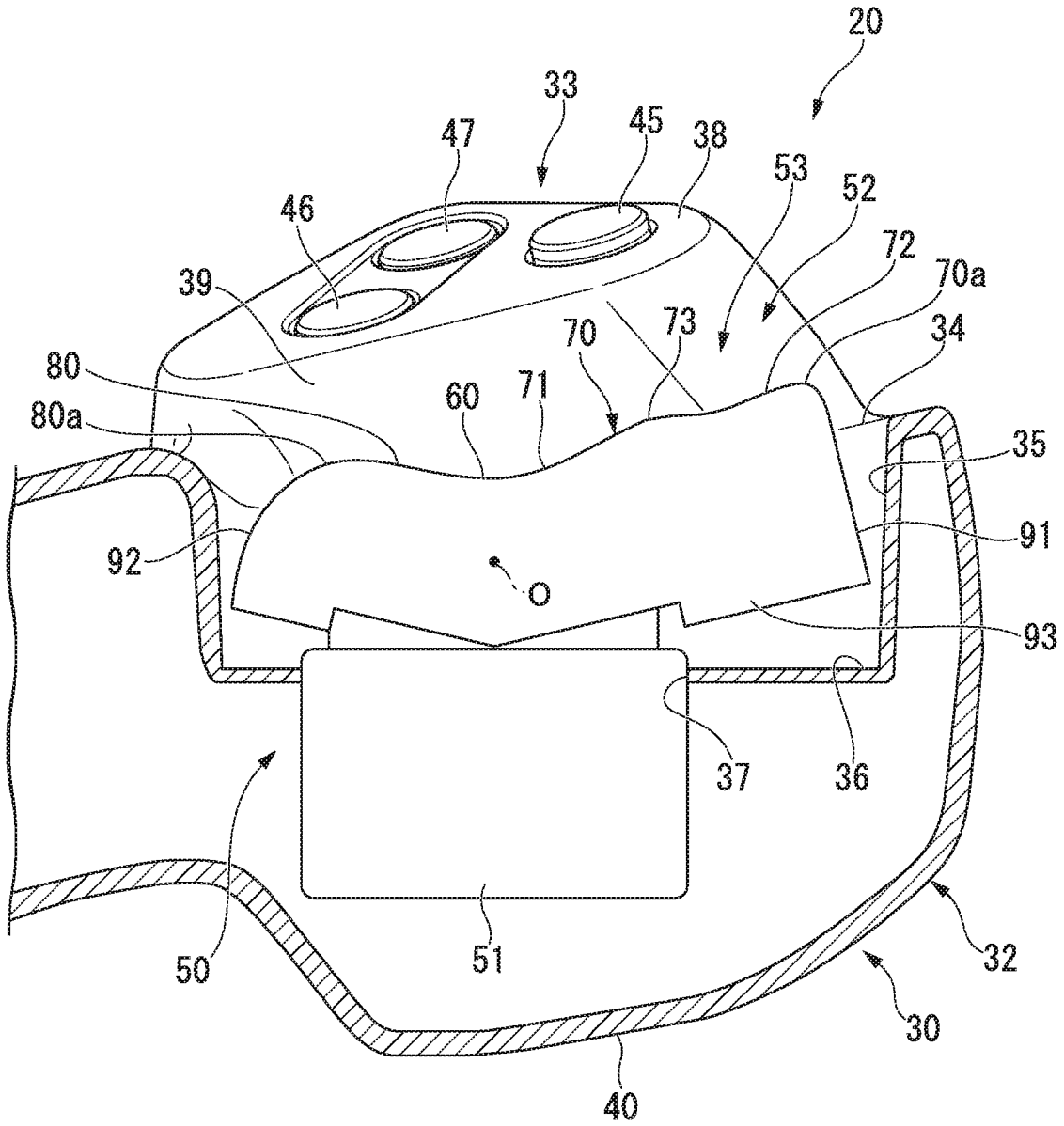
FIG. 6 is a cross-sectional view of the operation lever of the work vehicle according to the embodiment of the present invention, and the cross-sectional view is orthogonal to a rotation axis of a switch knob. The switch knob and a switch body are shown as a side view.

Here, a shape of the front surface 33 of the head portion 32 will be described in detail. The front surface 33 of the head portion 32 has a first switch placement surface 34 and a second switch placement surface 38 (a switch placement surface) as shown in FIG. 3 and FIG. 6.

In the front surface 33 of the head portion 32, the first switch placement surface 34 is a surface formed on a right-side region that is the driver's seat 10 side. The first switch placement surface 34 extends so as to extend continuously from the upper end of the grip portion 31. In the first switch placement surface 34, a switch-housing recess 35 recessed from the first switch placement surface 34 is formed. The switch-housing recess 35 is a recessed portion in which an extension direction of the first switch placement surface 34 is defined as a longer-side direction. On a bottom surface 36 of the switch-housing recess 35, a through-hole 37 communicating with a space inside the head portion 32 is formed.

The second switch placement surface 38 is disposed on the left side which is the opposite side of the driver's seat 10 side when viewed from the first switch placement surface 34. The second switch placement surface 38 is a surface which is disposed at a position protruding to the front surface side that is obliquely upward side of the first switch placement surface 34. The second switch placement surface 38 is adjacent to the first switch placement surface 34 in a front view viewed from the front surface 33 side (hereinafter, referred to as "front view"), and a surface shape of the second switch placement surface 38 has a triangular shape that has a side along the extension direction of the first switch placement surface 34.

Between the second switch placement surface 38 and the first switch placement surface 34, a lateral wall surface 39 is formed. The lateral wall surface 39 is a surface forming a step portion between the second switch placement surface 38 and the first switch placement surface 34. The lateral wall surface 39 rises to the front surface side that is an obliquely upward side from a left-side edge in the first switch placement surface 34, and is provided to extend to the extension direction of the first switch placement surface 34. As a result, the lateral wall surface 39 is directed to the right side that is the driver's seat 10 side. The second switch placement surface 38 is formed so as to extend toward the left side from a front surface-side edge that is an obliquely upper side of the lateral wall surface 39.

<Horn Switch>

The horn switch 45 is a switch which sounds a horn to indicate a warning, a cue or the like, by being pressed. The horn switch 45 is disposed at a position along the lateral wall surface 39 in the second switch placement surface 38.

<Downshift Switch>

The downshift switch 46 is a switch for changing a gear of a transmission (not shown) of the wheel loader 200 one step slower by being pressed. The downshift switch 46 is disposed at a position along the lateral wall surface 39 in the second switch placement surface 38 and at the position closer to the grip portion 31 side than the horn switch 45.

<Upshift Switch>

The upshift switch 47 is the switch changing the gear of the transmission of the wheel loader 200 one step faster by being pressed. The upshift switch 47 is disposed at a position with a distance to the left side from the horn switch 45 and the downshift switch 46.

<Forward-Reverse Changeover Switch>

Next, the forward-reverse changeover switch 50 will be described. The forward-reverse changeover switch 50 is a switch for changing movement in forward and backward directions of the vehicle body 220. The forward-reverse changeover switch 50 is a so-called seesaw switch. The forward-reverse changeover switch 50 has a switch body 51 and a switch knob 52 as shown in FIG. 6.

The switch body 51 is housed in the space of the inside of the head portion 32. The switch body 51 has a plurality of contact points and outputs an advancing signal, a reverse signal, and a neutral signal by the contact points being opened and closed in accordance with an orientation of the switch knob 52. In accordance with these signals, the vehicle body is set to the forward movement enabled state, the backward movement enabled state, and the neutral state which is impossible to move in forward and reverse. Part of the switch body 51 protrudes to an inside of the switch-housing recess 35 through the through-hole 37 formed at the bottom of the switch-housing recess 35.

<Switch Knob>

The switch knob 52 is provided in the switch-housing recess 35. The switch knob 52 has a rectangular shape so that the longer-side direction and shorter-side direction of which are matched to the switch-housing recess 35. Hereinafter, the shorter-side direction of the switch knob 52 is referred to as "a width direction of the switch knob 52" or simply as "the width direction". Also, the longer-side direction of the switch knob 52 is referred to as "front-rear directions of the switch knob 52" or simply as "front-rear directions".

The switch knob 52 is connected to a portion protruding to the switch-housing recess 35 in the switch body 51. The switch knob 52 is rotatably connected to the switch body 51 so as to be around a rotation axis O with the rotation axis O extending in the width direction as a fulcrum. The rotation axis O of the switch knob 52 extends in the width direction in the switch housing space. The rotation axis O of the switch knob 52 is parallel to the width direction and perpendicular to the front-rear directions. The front-rear directions of the switch knob 52 are directions perpendicular to the rotation axis O.

A surface of the switch knob 52 exposed on the front surface side that is the side obliquely above the switch-housing recess 35 is used as an operation surface 53. The operation surface 53 is a surface, the longer-side direction of which is the longitudinal direction of the switch knob 52 and the shorter-side direction of which is the width direction of the switch knob 52. The operation surface 53 is operated by a thumb of the left hand of the operator seated on the driver's seat 10.

The operation surface 53 is constituted by a connection portion 60, a front operation surface 70, and a rear operation surface 80.

The connection portion 60 is a portion connecting the front operation surface 70 and the rear operation surface 80 in the front-rear directions. The connection portion 60 extends linearly and in parallel to the rotation axis O. In other words, the connection portion 60 uniformly extends in the width direction. The connection portion 60 is regarded as the portion closest to the rotation axis O of the operation surface 53. In the present embodiment, the connection portion 60 is a position connecting the front operation surface 70 and the rear operation surface 80, and is set as a point as described later in a cross-sectional view orthogonal to the rotation axis O.

Figure 7:
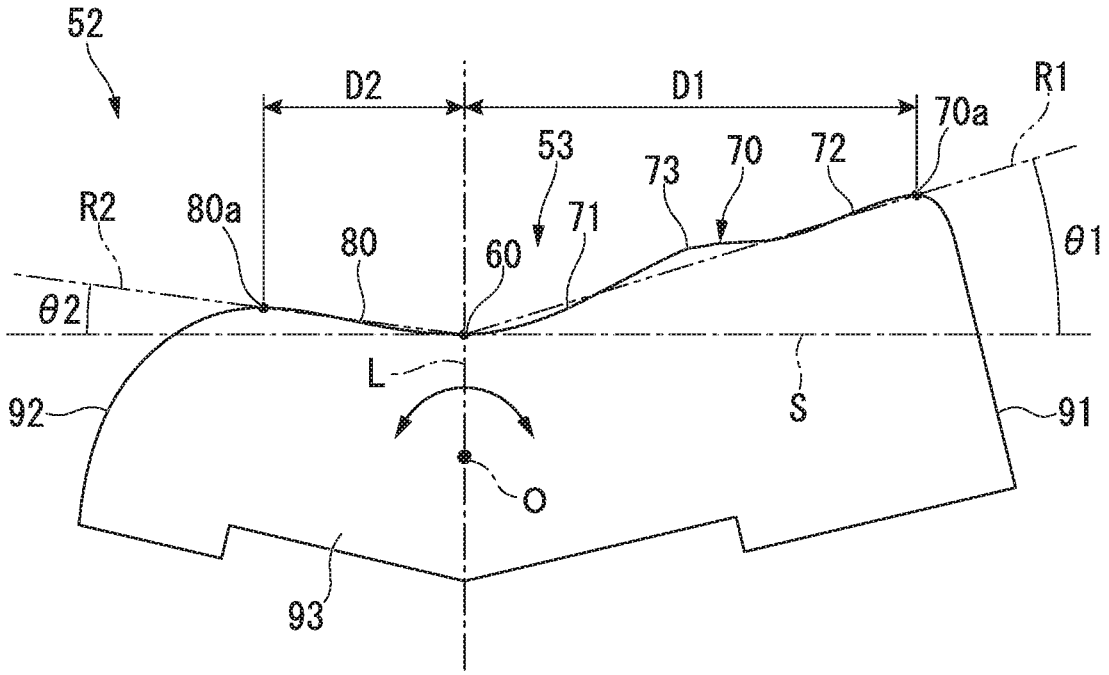
FIG. 7 is a side view of the switch knob of the operation lever of the work vehicle according to the embodiment of the present invention.

Here, as shown in FIG. 7, a reference plane S is defined as a virtual plane orthogonal to the reference line L which passes through the rotation axis O and the connection portion 60 in the cross-sectional view orthogonal to the rotation axis O. In the present embodiment, the reference plane S passes through the connection portion 60. The reference plane S may be defined as a virtual plane located closer to the rotation axis O side than the connection portion 60 in the cross-sectional view orthogonal to the rotation axis O.

The front operation surface 70 extends obliquely so that a height from the reference plane S increases toward the forward side from the connection portion 60 in the cross-sectional view including the front-rear directions. A front-side edge of the front operation surface 70 is supposed to be a front-side top portion 70*a*. The front-side top portion 70*a* is the portion of the front operation surface 70 having the largest height from the reference plane S. The front operation surface 70 uniformly extends in the width direction.

The rear operation surface 80 extends to be inclined so that the height from the reference plane S becomes larger toward the backward side from the connection portion 60 in the cross-sectional view including the front and back direction. The rear-side edge of the rear operation surface 80 is a rear-side top portion 80*a*. The rear-side top portion 80*a* is the portion of the rear operation surface 80 with the largest height from the reference plane S. A boundary between the front operation surface 70 and the rear operation surface 80 is formed in a concave curved shape that is continuous with the front operation surface 70 and the rear operation surface 80. The location closest to the rotation axis O in the concave curved shape is defined as the connection portion 60. The rear operation surface 80 extends uniformly in the width direction.

As shown in FIG. 3, on the left side which is one side of the width direction of the front operation surface 70, the horn switch 45 is arranged adjacent to the front operation surface 70 when viewed in the front view.

As shown in FIG. 3, on the left side which is one side of the width direction of the rear operation surface 80, the downshift switch 46 is arranged adjacent to the rear operation surface 80 when viewed in the front view.

Here, a length D1 in the front-rear directions along the reference plane S in the front operation surface 70 is longer than a length D2 in the front-rear directions along the reference plane S in the rear operation surface 80. For example, it is preferable that D1 be 1.2 to 2.5 times D2. It is more preferable that L1 be 1.3 to 1.8 times L2. It is still more preferable that L1 be 1.4 to 1.6 times L2 and most preferably 1.5 times L2. The height of the front-side top portion 70*a* from the reference plane S is greater than the height from the reference plane S of the rear-side top portion 80*a*.

At the cross-sectional view orthogonal to the rotation axis O, a straight line connecting the connection portion 60 and the front-side top portion 70*a* is defined as a front inclined line R1, and a straight line connecting the connection portion 60 and the rear-side top portion 80*a* is defined as a rear sloping line R2.

In the present embodiment, an acute angle θ1 formed by the front inclined line R1 and the reference plane S is larger than an acute angle θ2 formed by the rear inclined line R2 and the reference plane S. That is, an average inclined rate of the front operation surface 70 is larger than an average inclined rate of the rear operation surface 80.

The front operation surface 70 has a first inclined surface 71, a second inclined surface 72, and a projecting surface 73.

A rear-side edge of the first inclined surface 71 is connected to the connection portion 60 and the first inclined surface 71 is a surface inclined on an upward gradient from the connection portion 60 toward the forward side of the first inclined surface 71. A front-side edge of the second inclined surface 72 is connected to the front-side top portion 70*a* and the second inclined surface 72 is a surface inclined on a downward gradient from the front-side top portion 70*a* toward the backward side of the second inclined surface 72.

The projecting surface 73 is disposed between the first inclined surface 71 and the second inclined surface 72, and protrudes so as to rise more than the first inclined surface 71 and the second inclined surface 72. That is, the protruding amount of the projecting surface 73 from the front inclined line R1 is greater than the first inclined surface 71 and the second inclined surface 72. A portion in the projecting surface 73 protruding with respect to the front inclined line R1 has a convex curved shape. A boundary between the projecting surface 73 and the first inclined surface 71 has a concave curved shape that continues to the projecting surface 73 and the first inclined surface 71. A boundary between the projecting surface 73 and the second inclined surface 72 has a concave curved surface that continues to the projecting surface 73 and the second inclined surface 72.

A front surface 91 facing the forward side of the switch knob 52 is continuously connected to the front-side top portion 70*a* of the front operation surface 70. A rear surface 92 facing the backward side of the switch knob 52 is continuously connected to the rear-side top portion 80*a* of the rear operation surface 80. On both sides in the width direction of the operation surface 53, the front surface 91, and the rear surface 92, a pair of lateral surfaces 93 is formed. These lateral surfaces 93 are connected to the operation surface 53, the front surface 91, and the rear surface 92 so as to be continuous thereto.

Figure 8:
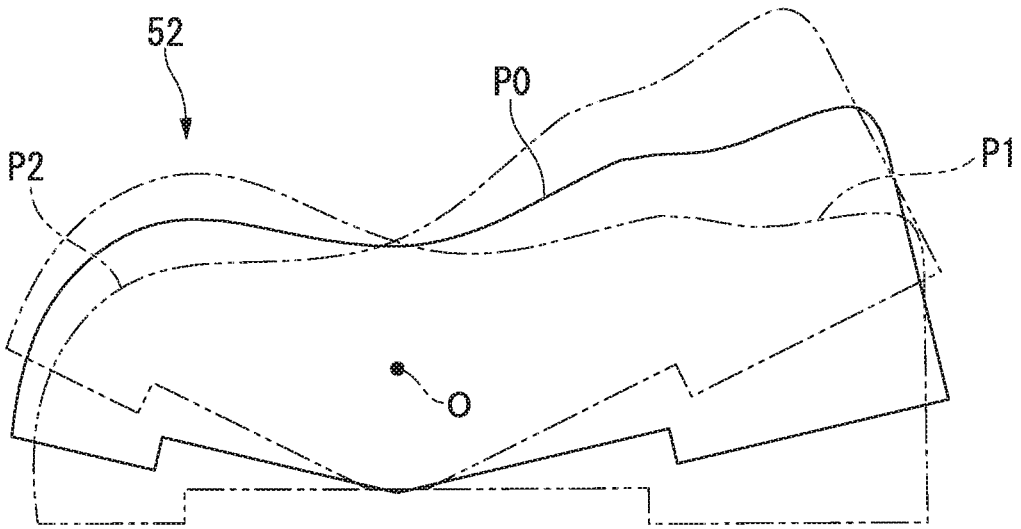
FIG. 8 is a diagram showing a neutral position, a forward movement position, and a backward movement position of the switch knob of the operation lever of the work vehicle according to the embodiment of the present invention.

As shown in FIG. 8, the switch knob 52 rotates around the rotation axis O between a neutral position P0, a forward position P1 and a backward position P2. The neutral position P0 is a position which is not tilted to either the front or the rear. If the switch knob 52 is in the neutral position P0, a neutral signal is outputted from the switch body 51.

The forward movement position P1 is a position where the switch knob 52 is tilted forward. The switch knob 52 in the forward movement position P1 is in a state in which the front operation surface 70 is pushed in and the rear operation surface 80 is bounced up. When the switch knob 52 is in the forward movement position P1, a forward movement signal is outputted from the switch body 51.

The backward movement position P2 is a position where the switch knob 52 is tilted backward. The switch knob 52 in the backward movement position P2 is in a state in which the rear operation surface 80 is pushed in and the front operation surface 70 is bounced up. When the switch knob 52 is in the backward movement position P2, a backward movement signal is outputted from the switch body 51.

In any of the cases where the switch knob 52 is in the neutral position P0, in the forward movement position P1, and in the backward movement position P2, the operation surface 53 is exposed to the front surface side that is obliquely upward from the switch-housing recess 35.

<Operation and Effects>

When the operator operates the wheel loader 200, the operator operates the direction-switching operation lever 20 by the left hand. At this time, the thumb of the left hand of the operator is placed on the operation surface 53 of the switch knob 52.

When allowing the wheel loader 200 to be in a forward state, the operator presses the front operation surface 70 with the thumb pulp. At this time, the portion around the front-side top portion 70*a* in the front operation surface 70 becomes an operating point which makes the front operation surface 70 the easiest to operate. When the front operation surface 70 is pressed, the switch knob 52 is rotated, whereby the switch knob 52 is tilted from the neutral position P0 to the forward movement position P1. As a result, when the accelerator pedal 11 is stepped on, the wheel loader 200 moves forward.

On the other hand, when allowing the wheel loader 200 to be in a backward state, the operator presses the rear operation surface 80 with the thumb. At this time, a portion around the rear-side top portion 80*a* of the rear operation surface 80 becomes an operating point which makes the rear operation surface 80 the easiest to operate. When the rear operation surface 80 is pressed, the switch knob 52 is rotated, whereby the switch knob 52 is tilted from the neutral position P0 to the backward movement position P2. As a result, when the accelerator pedal 11 is stepped on, the wheel loader 200 moves backward.

Here, as a typical work of the wheel loader 200, there is an earthwork-and-loading work, such as a V-type loading, and loading and carrying. In such earthwork-and-loading work by the wheel loader 200, the wheel loader 200 behaves as follows. First, the wheel loader 200 travels by switching into the forward movement for performing earthwork, and performs earthwork of earth and sand etc. by the bucket 212. Then, the wheel loader 200 travels by switching into the backward movement along with raising the working equipment, and further travels by switching into the forward movement in order for removing the earth and sand etc. contained in the bucket 212 in a predetermined place. In the process of such an operation, at the time of the forward movement or the backward movement, a necessary turning is performed at the same time so that the wheel loader 200 is capable of approaching the earthwork target and earth removal place. In other words, at the time of the earthwork-and-loading work, the operator operates the working equipment 210 by the bucket operation lever 13 and the lift arm operation lever 14, switches the forward movement to the backward movement or the backward movement to the forward movement of the wheel loader 200 with the thumb of the left hand while operating the accelerator pedal 11 and the brake pedal 12, and performs an operation of turning the direction-switching operation lever 20 to either the right or left.

Here, supposing that in a case where the front operation surface 70 and the rear operation surface 80 in the operation surface 53 of the switch knob 52 have a shape symmetrical about the connection portion 60 as a boundary, that is, in the case where the length of the front operation surface 70 and the length of the rear operation surface 80 are equivalent and the height of the front-side top portion 70*a* and the height of the rear-side top portion 80*a* are equivalent, the following problems may occur.

That is, when attempting to press around the operating point of the rear operation surface 80 by the thumb pulp in order to allow the wheel loader 200 to be in a state of being capable of moving backward from a state in which around the operating point of the front operation surface 70 is pressed by a tip portion of the thumb pulp, it is necessary to greatly change the posture of the thumb. In the state of pressing the operating point of the front operation surface 70, the thumb is in an elongation state; however, when pressing the operating point of the rear operation surface 80, the posture of the thumb has to be changed so as to bend a joint of the thumb largely inside while pulling the thumb backwards. If such action is repeated, a burden to the thumb increases and will contribute to one factor of fatigue of the operator. Especially, when the shape of the thumb of the operator is longer than expected with respect to the operation surface 53 of the switch knob 52, it is impossible to perform smooth switching unless largely varying the posture of the thumb.

In contrast, in the present embodiment, the length in the front-rear directions of the front operation surface 70 is longer than the length of the rear operation surface 80, and the height of the front-side top portion 70*a*, which becomes around the operating point of the front operation surface 70, is higher than the height of the rear-side top portion 80*a*, which is around the operating point of the rear operation surface 80.

Thus, the operator is capable of switching the switch knob 52 from the forward movement position P1 to the backward movement position P2 without greatly changing the posture of the thumb.

That is, in the present embodiment, since the front operation surface 70 of the switch knob 52 extends greatly forward, the operating point is located farther from the connection portion 60. Therefore, it is easy for the operator having a long thumb to press the operating point of the front operation surface 70 with the tip portion of the thumb pulp.

On the other hand, in the state of pressing the operating point of the front operation surface 70 as described above by the tip portion of the thumb pulp without bending the thumb, a base-side portion of the thumb becomes closer to around a position facing the operating point of the rear operation surface 80 than a first joint of the thumb. That is, in a state in which a distance toward the forward side from the connection portion 60 is large and around the front-side top portion 70*a* having a large height from the reference plane S is pressed by the tip portion of the thumb pulp, a distance toward the backward side from the connection portion 60 is relatively small and around a portion between the first joint and the second joint of the thumb faces the operating point of the rear operation surface 80 having a relatively small height from the reference plane S.

Therefore, from the posture in which the thumb presses the operation surface 53 of the front operation surface 70, when acting so as to extend the thumb while warping the thumb without bending the joint of the thumb inward, the base-side portion of the thumb rather than the first joint of the thumb moves in a direction pressing around the operating point of the rear operation surface 80. This portion is a portion where the displacement is large when performing the action of extending the thumb while warping it. Therefore, without performing an action of increasing bending of the thumb, it is possible to press around the operating point of the rear operation surface 80 by performing a simple action.

In the present embodiment, since the average inclined rate of the front operation surface 70 is larger than the average inclined rate of the rear operation surface 80, the above operation and effects become more remarkable.

Therefore, it is possible to easily switch the forward movement and the backward movement even though the operator has a long thumb.

Incidentally, in a case of supposing that a length in the front-rear directions along the reference plane S of the rear operation surface 80 is equivalent to a length in the front-rear directions along the reference plane S of the front operation surface 70, the operating point of the rear operation surface 80 will deviate greatly from the vicinity of the first joint of the thumb of the left hand.

While on the other hand, for the operator having a short thumb, it becomes difficult to press the front operation surface 70 unless extending greatly the thumb when the operating point of the front operation surface 70 becomes far. However, in the present embodiment, in a middle of the front-rear directions of the front operation surface 70, the projecting surface 73 is formed. Therefore, the operator having a short thumb is able to easily rotate the switch knob 52 to the forward movement position P1 by pressing the projecting surface 73. Since the projecting surface 73 has a projection as a shape, when the operator having a short thumb would like to rotate the switch knob 52 to the forward movement position P1, it is possible for the operator to recognize the pressing position by feeling the position of the projecting surface 73 with the thumb pulp, and also it is possible to recognize the pressed position visibly. That is, since the vicinity of a top portion of the projecting surface 73 is possible to be set as the second operating point of the front operation surface and the rear operation surface, it is possible to perform a switching operation of the forward movement without a burden by operating the projecting surface 73.

Furthermore, since the boundary between the projecting surface 73 in the front operation surface 70 and the second inclined surface 72 at the forward side of the projecting surface 73 has a concave curved shape, in the state in which the operator having a long thumb presses around the operating point of the front operation surface 70 by the tip portion of the thumb pulp, the thumb pulp will fit along the concave curved surface. Accordingly, it is possible to stabilize the posture of the thumb without a burden, and therefore, it is possible to further improve operability. According to the direction-switching operation lever 20 having such switch knob 52, regardless of the length of the thumb, the operator can operate the wheel loader 200 without causing feeling of fatigue and discomfort.

Here, for a turning operation of the wheel loader 200, the direction-switching operation lever 20 is rotated to left and right in a state where the operator is holding the direction-switching operation lever 20 with the left hand. Therefore, all fingers on the left hand need to be placed stably without shaking.

In the present embodiment, on the left that is one side in the width direction of the switch knob 52, the lateral wall surface 39 extending in the front-rear directions of the switch knob 52 is formed. The thumb on the switch knob 52 is restricted from moving to the left side by the side wall surface 39. Therefore, it is possible to suppress a movement of the thumb and place the thumb stably on the switch knob 52. In the earthwork-and-loading operation performed by the wheel loader 200, as described above, it is necessary to switch frequently a turning operation and a forward-backward movement operation by the direction-switching operation lever 20. For the left turn, when the direction-switching operation lever 20 is turned to the left, a left side portion of the thumb abuts the lateral wall surface 39, and therefore, the direction-switching operation lever 20 becomes easy to press to the left and it is possible to reduce feeling of fatigue and discomfort caused by the burden of the wrist or the arm of the operator.

Further, in the state where the operator grasps the direction-switching operation lever 20, the index finger is housed in the index finger-housing space 42. Since the index finger is restricted in movement by the flange 41 and the back surface 40 of the head portion 32, the stability of the index finger can be maintained. Thus, it possible to further improve operability particularly when turning the direction-switching operation lever 20. Since at least the grip portion 31, the index finger-housing space 42, and the flange 41 are provided in the direction-switching operation lever 20, the operator can grasp the direction-switching operation lever 20 securely without slipping of the left hand and the operator can smoothly perform the turning operation.

Moreover, since the horn switch 45 is disposed adjacent to the left side which is one side in the width direction of the front operation surface 70 in the operation surface 53, the operator can press the horn switch 45 by simply shifting the thumb placed on the front operation surface 70 to the left. After pressing the horn switch 45, the thumb can rearrange on the front operation surface 70 by simply shifting the thumb to the right.

Therefore, it is possible to easily switch between the operation of the switch knob 52 and the operation of the horn switch 45. As a result, attention to the surroundings during work can be smoothly performed.

Other Embodiments

Although the embodiment of the present invention has been described above, the present invention is not limited thereto but can be appropriately changed without departing from the technical idea of the invention. In the present embodiment, the left side of the driver's seat 10 is defined as one side in the vehicle width direction (one side in the right and left directions), and the direction-switching operation lever 20 is disposed on the left side of the driver's seat 10; however, it is not limited thereto. The direction-switching operation lever 20 may be disposed on the right side of the driver's seat 10. In this case, a structure of the direction-switching operation lever 20 which is reversed in the right and left from the direction-switching operation lever 20 described in the embodiment will be adopted.

In the present embodiments, an example in which the present invention is applied to the direction-switching operation lever 20 of the wheel loader 200 has been described as an example of the work vehicle; however, the present invention may be applied to other work vehicles such as a bulldozer.

INDUSTRIAL APPLICABILITY

According to the above aspects of the operation lever and the work vehicle, the forward movement and the backward movement can be easily switched.

BRIEF DESCRIPTION OF THE REFERENCE SYMBOLS

10: Driver's Seat
11: Accelerator Pedal
12: Brake Pedal
13: Bucket Operation Lever
14: Lift Arm Operation Lever
15: Turning Groove Portion
20: Direction-Switching Operation Lever (Operation Lever)
30: Lever Body
31: Grip Portion
32: Head Portion
33: Front Surface
34: First Switch Placement Surface
35: Switch-Housing Recess
36: Bottom Surface
37: Through-Hole
38: Second Switch Placement Surface (Switch Placement Surface)
39: Lateral Wall Surface
40: Back Surface
40*a*: Lateral Surface
41: Flange
42: Index Finger-Housing Space
45: Horn Switch
46: Downshift Switch
47: Upshift Switch
50: Forward-Reverse Changeover Switch
51: Switch Body
52: Switch Knob
53: Operation Surface
60: Connection Portion
70: Front Operation Surface
70*a*: Front-Side Top Portion
71: First Inclined Surface
72: Second Inclined Surface
73: Projecting Surface
80: Rear Operation Surface
80*a*: Rear Inclined Portion
91: Front Surface
92: Rear Surface
93: Lateral Surface
200: Wheel Loader
210: Working Equipment
211: Boom
212: Bucket
213: Link
214: Bell Crank
215: Boom-Driving Cylinder
216: Bucket-Driving Cylinder
220: Vehicle Body
230: Vehicle Front Part
240: Vehicle Rear Part
250: Front Wheel
260: Rear Wheel
270: Cab
O: Rotation Axis
L: Straight Reference Line
S: Reference Plane
D1: Length of Front Operation Surface
D2: Length of Rear Operation Surface
R1: Front Inclined Line
R2: Rear Inclined Line
θ1: Angle Of Front Inclined Line
θ2: Angle Of Rear Inclined Line
P0: Neutral Position
P1: Forward Position
P2: Backward Position

The invention claimed is:

1. An operation lever of a work vehicle, comprising:

a lever body including a grip portion extending vertically and a head portion provided on an upper end of the grip portion; and a switch knob having an operation surface exposed on a front surface of the head portion, and provided so as to be rotatable around a rotation axis extending in a width direction between a forward position and a backward position, the forward position being a position tilted forward from a neutral position, the backward position being a position tilted backward from the neutral position, the operation surface including:

a connection portion extending in the width direction;

a front operation surface extending obliquely so that a height from a reference plane perpendicular to a straight line passing through the rotation axis and the connection portion increases from the connection portion toward a forward side of the connection portion in a cross-sectional view perpendicular to the rotation axis, and a front-side edge of the operation surface being defined as a front-side top portion; and a rear operation surface connected to the front operation surface via the connection portion, extending obliquely so that a height from the reference plane increases from the connection portion toward a backward side of the connection portion, and a rear-side edge of the operation surface being defined as a rear-side top portion, wherein a length in front-rear directions along the reference plane in the front operation surface is larger than a length in the front-rear directions along the reference plane in the rear operation surface, and wherein a height of the front-side top portion from the reference plane is higher than a height of the rear-side top portion from the reference plane;

wherein the front operation surface includes:

a first inclined surface contacted with the connection portion;

a second inclined surface contacted with the front-side top portion; and a single projecting surface provided midway between the first inclined surface and the second inclined surface, and projecting from the first inclined surface and the second inclined surface.

2. The operation lever according to claim 1, further comprising:

a flange that is provided so as to protrude from an outer surface of the grip portion, and forms an index finger accommodation space between a back surface of the head portion and the flange.

3. A work vehicle, comprising:

a driver's seat; and the operation lever according to claim 1 configured to cause the work vehicle to turn either one side in a right or left direction of the driver's seat, which is one direction in the width direction.

4. The operation lever according to claim 1, wherein in the cross-sectional view, when a straight line passing through the connection portion and the front-side top portion is defined as a front inclined line and a straight line passing through the connection portion and the rear-side top portion is defined as a rear inclined line, an angle formed by the front inclined line and the reference plane is larger than an angle formed by the rear inclined line and the reference plane.

5. The operation lever according to claim 4, wherein the head portion includes:

a lateral wall surface that is disposed at one side in the width direction of the switch knob in the head portion, rises more than the switch knob, extends in a longitudinal direction, and faces an other side in the width direction.

6. The operation lever according to claim 4, further comprising:

a flange that is provided so as to protrude from an outer surface of the grip portion, and forms an index finger accommodation space between a back surface of the head portion and the flange.

7. A work vehicle, comprising:

a driver's seat; and the operation lever according to claim 4 configured to cause the work vehicle to turn either one side in a right or left direction of the driver's seat, which is one direction in the width direction.

8. The operation lever according to claim 1, wherein a boundary between the second inclined surface and the projecting surface is a concave curved shape.

9. The operation lever according to claim 8, wherein the head portion includes:

a lateral wall surface that is disposed at one side in the width direction of the switch knob in the head portion, rises more than the switch knob, extends in a longitudinal direction, and faces an other side in the width direction.

10. The operation lever according to claim 8, further comprising:

a flange that is provided so as to protrude from an outer surface of the grip portion, and forms an index finger accommodation space between a back surface of the head portion and the flange.

11. A work vehicle, comprising:

a driver's seat; and the operation lever according to claim 8 configured to cause the work vehicle to turn either one side in a right or left direction of the driver's seat, which is one direction in the width direction.

12. The operation lever according to claim 8, wherein a boundary between the projecting surface and the first inclined surface is a concave curved shape.

13. The operation lever according to claim 1, wherein the head portion includes:

a lateral wall surface that is disposed at one side in the width direction of the switch knob in the head portion, rises more than the switch knob, extends in a longitudinal direction, and faces an other side in the width direction.

14. The operation lever according to claim 13, wherein the head portion includes:

a switch placement surface that is connected to a side wall surface and extends from the side wall surface to a side in the width direction, wherein the operation lever further comprises:

a horn switch that is provided on the switch placement surface so as to be adjacent to the side in the width direction of the front operation surface.

15. The operation lever according to claim 14, further comprising:

a flange that is provided so as to protrude from an outer surface of the grip portion, and forms an index finger accommodation space between a back surface of the head portion and the flange.

16. The operation lever according to claim 13, further comprising:

a flange that is provided so as to protrude from an outer surface of the grip portion, and forms an index finger accommodation space between a back surface of the head portion and the flange.

17. A work vehicle, comprising:

a driver's seat; and the operation lever according to claim 13 configured to cause the work vehicle to turn either one side in a right or left direction of the driver's seat, which is one direction in the width direction.

18. The operation lever according to claim 13, wherein the lateral wall surface is provided without a switch.

* * * * *